United States Patent [19]

Lien

[11] Patent Number: 4,648,538

[45] Date of Patent: Mar. 10, 1987

[54] FLAGGING DISPENSER

[76] Inventor: Darryl A. Lien, 557 Bighorn Way, P.O. Box 673, Troy, Mont. 59935

[21] Appl. No.: 845,624

[22] Filed: Mar. 28, 1986

[51] Int. Cl.[4] ..... B65D 85/672

[52] U.S. Cl. ..... 225/78; 225/79

[58] Field of Search ..... 225/78, 79, 77, 82

[56] References Cited

U.S. PATENT DOCUMENTS

| | | | |
|---|---|---|---|
| 2,581,190 | 1/1952 | Hodges | 225/78 X |
| 4,088,276 | 5/1978 | Littleton | 225/78 X |
| 4,105,149 | 8/1978 | Stewart | 225/78 X |

*Primary Examiner*—Frank T. Yost

*Attorney, Agent, or Firm*—H. Jay Spiegel

[57] ABSTRACT

A flagging dispenser specifically designed to be wearable on the belt of the user thereof and including a recessed area designed to rotatably receive a role of flagging which is to be dispensed thereby. The device further includes a serrated edge disposed substantially parallel to the axis of rotation of the roll of flagging and provided to enable the user thereof to tear off a portion of the flagging at a desired region thereof. The device further includes the provision of a friction creating device provided in engagement with the sidewalls of the roll of flagging so as to provide resistance to rotation of the flagging roll to thereby prevent the flagging roll from unwinding uncontrollably. The belt engaging loop of the device is conveniently formed with an opening therethrough which facilitates the mounting of the flagging roll in the device.

5 Claims, 2 Drawing Figures

FLAGGING DISPENSER

BACKGROUND OF THE INVENTION

The present invention relates to a flagging dispenser. In the prior art, roll dispensing devices are well known, however, none is known to Applicant which includes each and every one of the inventive features as will be described in greater detail hereinafter. The following prior art is known to Applicant:

U.S. Pat. No. 1,703,703 to Anderson discloses a line dispensing device including a frame including a disk 12 which may be rotated by a handle 13 to thereby facilitate the winding and unwinding of a tape 14 having a sinker 15 attached thereto. The device includes the further provision of a brake device including rubber pads 31 which may be squeezed together by virtue of the handle 16 and the finger loop 29. This device is different from the present invention since the frictional braking means associated with the present invention is associated with the side of the flagging roll itself whereas in Anderson the braking means operates only on the end of the tape 14 which has been unrolled from the roll thereof.

U.S. Pat. No. 3,217,965 to Tinkey discloses a belt attached tape dispenser including a serrated portion 26 for cutting the tape, means for attaching the device to a belt 15, and a spindle 20 on which a roll 22 of tape may rotate. The present invention is different from the teachings of this device since this device includes none of the braking structure of the present invention and the serrated edge thereof is not structurally similar to the teachings of the present invention.

SUMMARY OF THE INVENTION

The present invention overcomes the deficiencies of the prior art as embodied in the above-discussed prior art by providing a device which in a simple manner enables one to controllably remove a predetermined length of flagging from a roll thereof while enabling the device to be conveniently attached to the belt and while preventing the flagging from unraveling uncontrollably. The present invention includes the following interrelated features:

(a) The device is preferably made with a U-shaped body having the serrated edge located at the bottom of the "U".

(b) One leg of the U-shaped body has a portion which is bent over and attached to the leg to provide a loop through which a belt may be inserted to enable the device to be mounted on the belt.

(c) Within the U-shaped body, a spindle is provided which is attached thereto by virtue of a threaded bolt having a wing-nut at one end thereof which is adapted to bear against the outside wall of the leg of the "U" remote from the above-described belt loop.

(d) The spindle is of a diameter compatible with the inner diameter of the central portion of the flagging roll and slidably fits therethrough when the roll is installed in the device.

(e) Within the U-shaped body, on each side of the flagging roll is disposed a large washer with the washer adjacent the leg of the "U" including the belt loop being adapted to bear against the side of the flagging roll while the enlarged washer on the other leg of the U-shaped body is spaced from the wall of the flagging roll by a smaller washer.

(f) Interposed between the washer which engages the walls of the flagging roll and the adjacent leg of the "U" a spring member is disposed which is adapted to bias the adjacent washer bearingly against the side wall of the flagging roll to thereby aid in the frictional engagement therebetween to thereby facilitate the prevention of uncontrolled unraveling of the flagging.

(g) The belt loop conveniently includes an opening therethrough which is provided to enable the spindle retaining bolt to be inserted through the U-shaped body by first inserting the bolt through the opening in the belt loop.

(h) In the preferred embodiment, the inventive body may be made of metal or plastic or any other material which is easy and inexpensive to manufacture.

Accordingly, it is a first object of the present invention to provide a flagging dispenser.

It is a further object of the present invention to provide such a flagging dispenser which is easy to use and includes structure thereon preventing undesirable unraveling of the flagging roll mounted thereon.

It is a still further object of the present invention to provide such a flagging dispenser with a belt loop which facilitates the attachment of the body thereof to the belt of the user thereof.

It is a still further object of the present invention to provide such a device with a serrated edge which facilitates the cutting off of a desired length of flagging.

It is a still further object of the present invention to provide such a device with the appropriate structure facilitating the easy replacement of the flagging roll when empty.

These and other objects, aspects, and features of the present invention will be better understood from the following detailed description of the preferred embodiments when read in conjunction with the appended drawing figures.

SPECIFIC DESCRIPTION OF THE PREFERRED EMBODIMENTS

Figure 1:
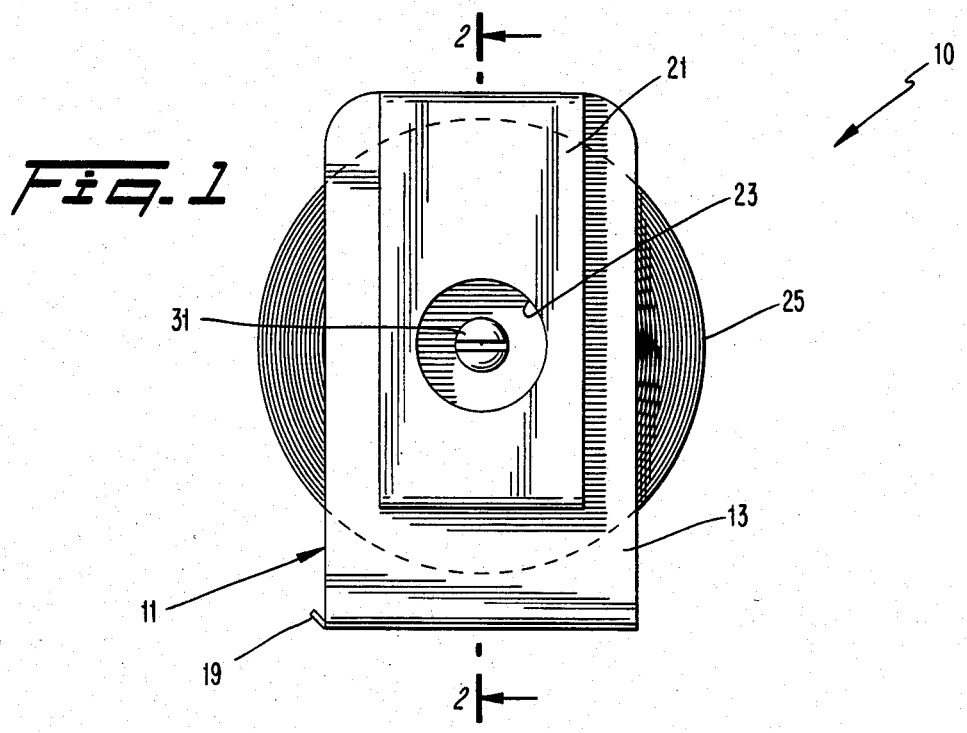
FIG. 1 shows a side view of the present invention.
Figure 2:
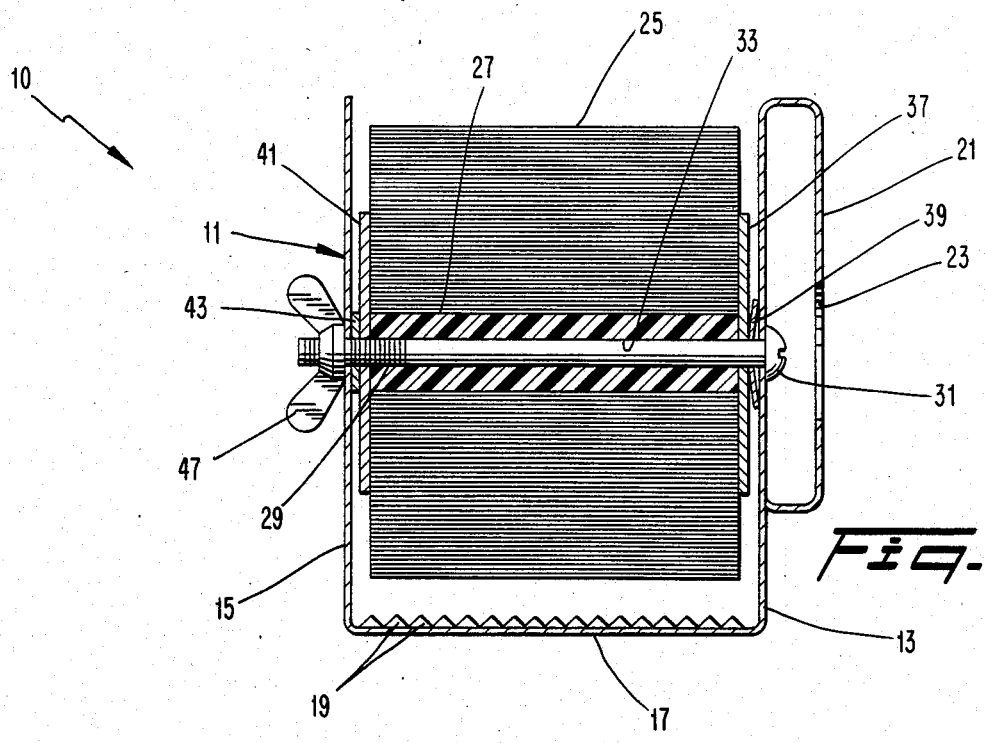
FIG. 2 shows a cross-sectional view along the line 2—2 of FIG. 1 with certain parts included to show detail.

With reference to FIGS. 1 and 2, the inventive flagging dispenser 10 is seen to include a U-shaped body 11 including a first leg 13, a second leg 15, and a bottom portion 17 having a serrated edge 19 thereon for a purpose to be described in greater detail hereinafter. Integrally formed with the leg 13 is a belt loop 21 which curves around as shown in FIG. 2 and is attached to the leg 13 at a lower portion thereof by any suitable means such as welding or soldering. As seen in FIGS. 1 and 2, the belt loop 21 includes an opening 23 for a purpose to be described in greater detail hereinafter. A roll of flagging 25 is inserted into the body 11 and is rotatably mounted on a spindle 27, a bolt 29 including a head 31, which bolt 29 is inserted through an opening 33 extending axially through the spindle 27.

As seen in the figures, the opening 23 in the belt loop is provided to enable the bolt 29 to be axially inserted therethrough and thence through the opening 33 in the spindle 27 to facilitate the installation of the flagging roll 25 in the device 10.

With reference to FIG. 2, it is seen that within the body 11, a washer 37 is mounted on the bolt 29 in a position wherein the washer 37 bearingly engages the sidewalls of the flagging roll 25, and the washer 37 is biased against the walls of the flagging roll 25 by the spring washer 39. Of course, if desired, the spring washer 39 may be replaced with a coil spring or any other suitable spring means.

As further shown with reference to FIG. 2, a further washer 41 is placed within the body 11 adjacent the leg 15 thereof but this washer 41 is spaced from the second leg 15 by a small washer 43. This is done to reduce the amount of frictional force which is imposed upon the second leg 15. However, if it is found that the frictional forces created by the engagement of the washers 37 and 41 and flagging roll 25 are too great upon the flagging roll 25, the washer 43 may be reversed with the washer 41 with the washer 43 made to engage the walls of the second leg 15 to reduce the frictional forces upon the flagging roll 25. As seen in FIG. 2, a wing-nut 47 is threadably mounted over the end of the bolt 29 and is made to bear against the leg 15 of the body 11 to thereby tighten the frictional engagement of the washers 37 against the flagging roll 25. As should be understood by those skilled in the art, tightening of the wing-nut 47 is a means for controlling the frictional force and thereby the retention force which is placed upon the flagging roll 25 to thereby control the manner in which the flagging roll may be unrolled.

When the roll 25 is empty, it is replaced by first removing the wing-nut 47 from the bolt 29, then removing the bolt 29 from the body 11 by pulling it through the opening 23 in the belt loop 21, then the spindle 27 may be removed from the body 11 and may be removed from the core (not shown) of the flagging roll 25 whereupon a new flagging roll may be placed over the spindle 27. Then, the assembly is reassembled taking care to install the spring 39, washer 37, washer 43 and washer 41 in the orientation as best seen in FIG. 2. Then, the wing-nut 47 may be tightened in bearing relation with the leg 15 to thereby adjust the frictional forces between the washer 37 and wall of the flagging roll 25 to the desired amount.

Accordingly, the present invention has been described hereinabove in terms of a single preferred embodiment thereof which overcomes all the deficiencies of the prior art and provides a simple device with great effectiveness, ease of operation and economy. Of course, various changes, alterations and modifications in the teachings of the present invention may be contemplated by those skilled in the art. Accordingly, it is stressed that it is intended that the present invention only be limited by the terms of the following claims.

I claim:

1. A flagging dispenser including:

(a) a U-shaped body;

(b) belt attachment means attached to a first leg of said body;

(c) a serrated edge on a bottom portion of said body:

(d) a spindle connected between said first leg and a second leg of said body;

(e) a flagging roll adapted to be mounted on said spindle; and (f) frictional braking means interposed between one of said legs and said roll and adapted to retard the rotation of said roll.

2. The invention of claim 1, wherein said spindle, includes a passageway extending axially therethrough, and a bolt inserted through said passageway and having a head adapted to bear against one of said legs and including fastening means bearing against the other of said legs to mount said spindle in said body.

3. The invention of claim 2, wherein said belt attachment means includes an opening therethrough, said bolt being inserted through said opening and thence through said spindle passageway.

4. The invention of claim 1, wherein said frictional braking means comprises:

(a) a washer engaging a side wall or said roll; and (b) biasing means interposed between said washer and said one of said legs to bias said washer into frictional engagement with said roll.

5. The invention of claim 2, wherein said fastening means comprises a wing-nut.

* * * * *